US005687447A

United States Patent [19]

Bynum et al.

[11] Patent Number: 5,687,447

[45] Date of Patent: Nov. 18, 1997

[54] STIFF HANDLED BACK SCRUBBER DEVICE

[75] Inventors: Cheryl Bynum; Bart L. Bynum, both of Ransom Canyon, Tex.

[73] Assignee: Bynum Concepts Inc., Lubbock, Tex.

[21] Appl. No.: 526,847

[22] Filed: Sep. 11, 1995

[51] Int. Cl.[6] ..... A47L 13/46

[52] U.S. Cl. ..... 15/229.13; 15/210.1; 15/227

[58] Field of Search ..... 15/209.1, 110, 15/104.05, 210.1, 227, 229.13, 229.11, 231, 143.1, 147.1, 147.2, 228; D28/63; 601/137, 138

[56] References Cited

U.S. PATENT DOCUMENTS

| | | | |
|---|---|---|---|
| 269,247 | 12/1882 | Waters . | |
| 1,634,907 | 7/1927 | Lester | 15/147.1 |
| 1,993,215 | 3/1935 | Hoyt et al. | 15/209.1 |
| 2,011,729 | 8/1935 | Reinhard . | |
| 2,306,809 | 12/1942 | Jeung | 15/147.2 |
| 2,423,484 | 7/1947 | Cosgro . | |
| 2,450,932 | 10/1948 | Beard . | |
| 2,517,067 | 8/1950 | Wedler . | |
| 2,652,615 | 9/1953 | Lasley . | |
| 2,658,220 | 11/1953 | Chapman | 15/209.1 |
| 2,798,515 | 7/1957 | York . | |
| 2,825,084 | 3/1958 | Sanborn | 15/210.1 |
| 2,826,802 | 3/1958 | Beard . | |
| 2,846,708 | 8/1958 | Vosbikian et al. | 15/227 |
| 3,140,330 | 7/1964 | Gutierrez . | |
| 3,281,884 | 11/1966 | Feil . | |
| 3,332,124 | 7/1967 | Beard . | |
| 3,343,196 | 9/1967 | Barnhouse | 15/229.11 |
| 3,345,668 | 10/1967 | Forrest . | |
| 3,508,286 | 4/1970 | Rosen . | |
| 3,877,105 | 4/1975 | Breland | 15/229.11 |
| 3,959,841 | 6/1976 | Horne . | |
| 4,067,325 | 1/1978 | Olask . | |
| 4,190,921 | 3/1980 | Rose | 15/229.11 |
| 4,196,490 | 4/1980 | Jonzon . | |
| 4,343,061 | 8/1982 | Hanazono . | |
| 4,462,135 | 7/1984 | Sanford . | |
| 4,473,929 | 10/1984 | Green . | |
| 4,761,849 | 8/1988 | Taylor . | |
| 5,144,744 | 9/1992 | Campagnoli . | |
| 5,205,012 | 4/1993 | Coley | 15/231 |
| 5,295,280 | 3/1994 | Hudson et al. . | |

FOREIGN PATENT DOCUMENTS

| | | | |
|---|---|---|---|
| 0953388 | 12/1949 | France | 15/229.13 |
| JO 1029241A | 7/1987 | Japan . | |
| 0129829 | 1/1929 | Switzerland | 15/229.13 |

*Primary Examiner*—David Scherbel
*Assistant Examiner*—James F. Hook
*Attorney, Agent, or Firm*—Madan & Morris

[57] ABSTRACT

The present invention provides a washing device with a stiff, elongated handle and a scrubbing element disposed at one end of the handle. Two adjacent openings extend through one end of the handle and opposed portions of the scrubbing element are disposed on opposed sides of the handle adjacent to the two openings. A clasp extends through the two openings, around the adjacent opposed portions of the scrubbing element, and around the portion of the handle disposed between the two openings, thereby affixing the scrubbing element to the handle.

19 Claims, 2 Drawing Sheets

STIFF HANDLED BACK SCRUBBER DEVICE

FIELD OF THE INVENTION

The present invention relates to washing or cleaning devices, and more particularly to a stiff handled washing device that is especially suited for scrubbing the human back while showering or bathing.

BACKGROUND OF THE INVENTION

A number of washing implements have been used to scrub the human body. Such washing implements include washcloths, sponges, brushes, "loofahs" and other devices. Some of these implements are helpful to scrub areas of the body that are difficult to reach, such as the human back. Unfortunately, many of these implements are made of materials that either are not very durable, or are difficult to clean. Many of these implements also are not strong enough to apply a desired amount of pressure to the skin during scrubbing.

SUMMARY OF THE INVENTION

The present invention provides a washing device with a stiff, elongated handle and a scrubbing element disposed at one end of the handle. Two adjacent openings extend through one end of the handle and opposed portions of the scrubbing element are disposed on opposed sides of the handle adjacent to the two openings. A clasp extends through the two openings, around the adjacent opposed portions of the scrubbing element, and around the portion of the handle disposed between the two openings, thereby affixing the scrubbing element to the handle.

DETAILED DESCRIPTION OF THE INVENTION

The scrubber 10 (FIG. 1) of the present invention includes an elongated handle 12 and a scrubbing element 14. The handle preferably is made of wood or plastic. Any suitable material may be used to make the handle as long as the material is strong enough to withstand the stress on the handle when the user rubs the scrubbing element 14 against the body. In a preferred embodiment, the handle is made of wood, preferably maple, birch, or any suitable hardwood, and is about 1.25" wide (shown at A—A) and about 18" long (shown at B—B).

The scrubbing element 14 may be made of any suitable material for washing the body. In a preferred embodiment, the scrubbing element is made of netting that has open cells so that water from a shower or faucet can run through and clean the scrubbing element. The netting also preferably is made of non-porous material so that dirt and debris do not become trapped in pores in the netting, and so that the scrubber will dry rapidly. Although it is not absolutely necessary, it is preferable for the netting to be elastic so that the netting can be prestretched to add volume to the scrubbing element. Elasticity also is helpful because, if the netting is stretched during use, it will return to its original shape after stretching.

The netting preferably should be tubular so that it can be folded or layered onto itself to increase the bulk of the scrubbing element 14. Or, the scrubbing element 14 can be made of a plurality of loops of netting bunched together. A preferred netting is diamond mesh polyethylene netting, which may be obtained from a number of manufacturers. One such manufacturer is "NALTEX®," 203 Colorado, Austin, Tex. 78701.

Figure 2:
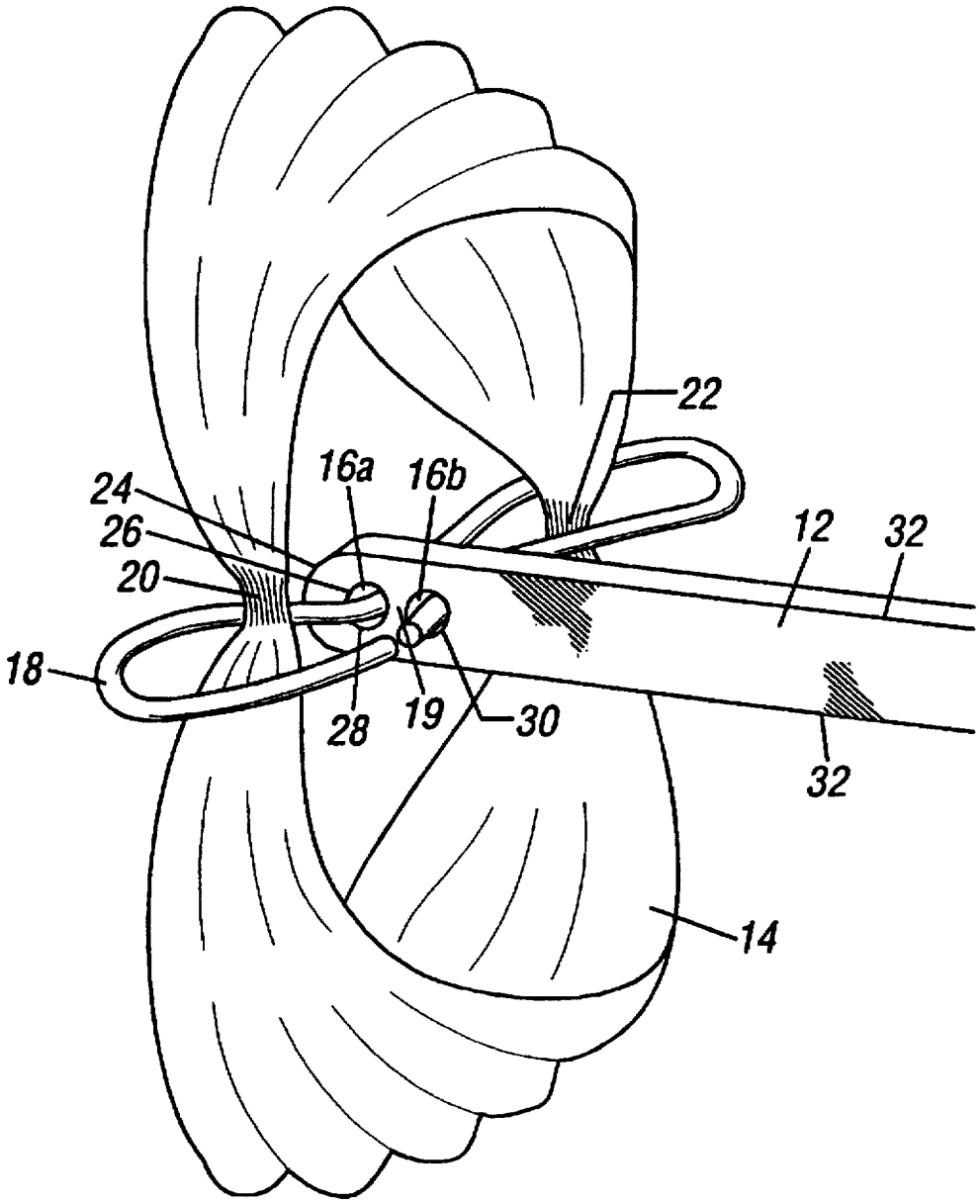
FIG. 2 is an exploded view illustrating the relationship of the scrubber, the clasp, and the handle.

The attachment of the scrubbing element 14 to the handle 12 is seen in detail in FIG. 2. Two adjacent openings 16*a*, 16*b* extend through one end of the handle 12. In a preferred embodiment: the openings 16*a* and 16*b* are about 3/16" in diameter; the distance between the end of the handle 24 and the edge 26 of the opening 16*a* is about 0.5"; the distance between the edge 28 of the opening 16*a* and the edge 30 of the opening 16*b* is about 0.5"; and, the distance between each edge 32 of the handle and the closest edge of the opening 16*a*, 16*b* is about 17/32".

Figure 1:
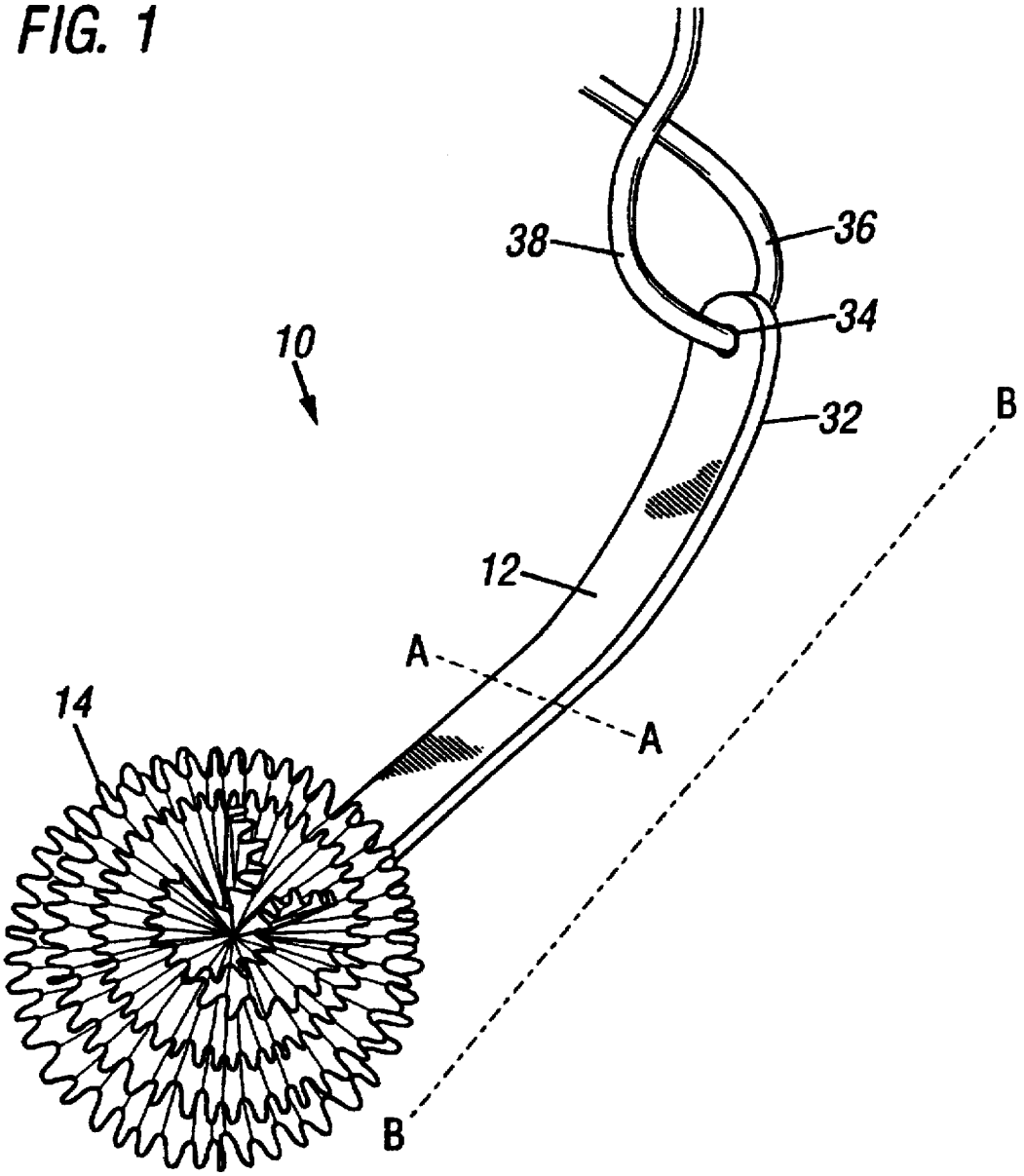
FIG. 1 is a perspective view of a scrubber according to the present invention.

A clasp 18 extends through the two openings, around the adjacent portions of the scrubbing element 14, and around the portion of the handle disposed between the two openings 19, forming a substantially continuous loop. When the clasp 18 is pulled tight, the clasp 18 bunches the netting tightly together 20, 22 on opposed sides of the handle 12. Where the scrubbing element is tubular netting, the result is a scrubbing element 14 substantially as depicted in FIG. 1.

The clasp 18 may be made of any suitable material. For example, the clasp 18 may be a durable cord or string, and preferably should be made of synthetic material that will not decompose after repeated exposure to water. The clasp 18 preferably should be made of material that is strong enough to affix the scrubbing element 14 to the handle 12 and pliable enough to not scratch the skin of the user during scrubbing. In a preferred embodiment, the clasp is a nylon cable tie, such as the 100% nylon Avery Dennison 8" Slim Line Bar-Lok® Cable Tie, part no 01327, 10325, available from a number of sources, such as Central Industrial Fasteners, Grand Prairie, Tex. Avery Dennison is located at 300 Howard Street, Framingham, Ma. 01701. The clasp preferably has a free end and a fastening head for non-reversibly engaging the free end. After placing the clasp around the adjacent portions of the scrubbing element 14, and around the portion of the handle disposed between the two openings 19, to form a substantially continuous loop, the free end may be slipped through the fastening head and secured.

Although the invention has been described with reference to a single scrubbing element 14, more than one scrubbing element can be attached along the length of the handle 12.

In a preferred embodiment, a third opening 34 is provided through the end of the handle opposite the scrubbing element 14. The opening 34 preferably is about 3/8" in diameter, and the adjacent edges of the opening 34 preferably should be spaced about 7/16" from each edge 32 of the handle. The bottom 36 of the handle preferably should be spaced about 1" from the adjacent edge of the opening 34. A loop of yarn 38 or other material may be extended through the opening 34 to hang the device when not in use.

Although specific dimensions have been given for certain aspects of the scrubber 10, persons of ordinary skill in the art will recognize that these dimensions may be readily varied.

Where one or more loops of netting are used as the scrubbing element 14, the width of the loop, measured along the axis of the tube of netting, may vary depending upon the type of netting used. If diamond mesh polyethylene netting is used, and only one loop of netting is used, the width of the loop preferably should be about 18 inches layflat. Where multiple loops are bunched together, the total width of the loops preferably should be about 18 inches layflat. The loop(s) should be wide enough to provide sufficient bulk to the scrubbing element 14, but not too wide to be bunched and comfortably fastened by the clasp 18. The length (or diameter) of the loops (measured perpendicular to the axis of the tube of netting) before stretching (if any) may vary depending on the diameter of the tubing available and the desired size of the scrubbing element 14. For a scrubber 10 having the dimensions previously described, the diameter of the loops preferably should be about 4 inches unstretched.

Where loops of netting are used for the scrubbing element, the loops do not necessarily have to be stretched before manufacturing the scrubber 10; however, as already mentioned, prestretching of the netting is preferred in order to add volume to the device. Stretching of the loops can be accomplished using any known means. For example, a mesh fabricator may be used. The mesh fabricator preferably is made of metal or other relatively smooth, strong material having a "U" shape which is slightly smaller at the bottom than at the legs of the "U". The loop(s) of netting may be urged over the narrower bottom of the "U" and along the legs of the "U" to a point where the distance between the legs is sufficient to stretch the loop. Preferably, the netting should be stretched to approximately 4–4½ times its unstretched length. For example, a 36 inch loop of diamond mesh polyethylene netting having a 4" inch (unstretched) diameter preferably should be stretched until it has a diameter of about 16 inches.

A person of skill in the art will recognize that many modifications may be made to the present invention without departing from the spirit and scope of the invention. The embodiments described herein are meant to be illustrative only and should not be taken as limiting the invention, which is defined in the following claims.

We claim:

1. A washing device comprising a stiff, elongated handle with first and second ends, a first end having first and second adjacent openings therethrough;

a scrubbing element with a first portion disposed adjacent to said first and second openings on a first side of said handle and a second portion disposed adjacent to said first and second openings on a second side of said handle; and a clasp looped through said first and second openings, around said first and second portions of said scrubbing element disposed adjacent to said first and second sides of said handle, and around a portion of said handle disposed between said first and second openings, thereby affixing said scrubbing element to said handle.

2. The washing device of claim 1 wherein said first and second openings are spaced longitudinally along said handle.

3. The washing device of claim 2 wherein said scrubbing element comprises diamond mesh polyethylene netting.

4. The washing device of claim 2 wherein said clasp comprises a nylon cable-tie type fastener.

5. The washing device of claim 2 wherein said handle is comprised of wood.

6. The washing device of claim 1 wherein said scrubbing element comprises at least one loop of scrubbing material wherein said loop of scrubbing material surrounds said handle and said first and second portions of said scrubbing element comprise opposed portions of said loop of scrubbing material.

7. The washing device of claim 6 wherein said scrubbing element comprises diamond mesh polyethylene netting.

8. The washing device of claim 7 wherein said clasp comprises a nylon cable-tie type fastener.

9. The washing device of claim 6 wherein said clasp comprises a nylon cable-tie type fastener.

10. The washing device of claim 6 wherein said handle is comprised of wood.

11. The washing device of claim 1 wherein said scrubbing element comprises diamond mesh polyethylene netting.

12. The washing device of claim 1 wherein said clasp comprises a nylon cable-tie type fastener.

13. The washing device of claim 1 wherein said handle is comprised of wood.

14. A washing device comprising a stiff, elongated handle with first and second ends, a first end having first and second adjacent openings therethrough spaced longitudinally along said handle;

a scrubbing element comprising at least one loop of scrubbing material surrounding said handle, a first portion of said loop of scrubbing material being disposed adjacent to said first and second openings on a first side of said handle and a second portion of said loop of scrubbing material being disposed adjacent to said first and second openings on a second side of said handle; and a clasp looped through said first and second openings, around said first and second portions of said scrubbing element disposed adjacent to said first and second sides of said handle, and around a portion of said handle disposed between said first and second openings, thereby affixing said scrubbing element to said handle.

15. The washing device of claim 14 wherein said scrubbing element comprises diamond mesh polyethylene netting.

16. The washing device of claim 15 wherein said clasp comprises a nylon cable-tie type fastener.

17. The washing device of claim 14 wherein said clasp comprises a nylon cable-tie type fastener.

18. The washing device of claim 14 wherein said handle is comprised of wood.

19. A process for producing a washing device comprising:

providing an elongated handle with two adjacent openings through one end;

positioning opposed portions of a scrubbing element on opposed sides of said handle adjacent to said two openings;

affixing said scrubbing element to said handle by extending a clasp through said openings, around said opposed portions of said scrubbing element, and around a portion of said handle disposed between said two openings.

* * * * *